United States Patent [19]

Legeay, nee Lechat et al.

[11] 4,080,113

[45] Mar. 21, 1978

[54] DEFORMABLE FLEXIBLE TUBE CONSTITUTING THE BODY OF A PERISTALTIC PUMP

[75] Inventors: Hélène Legeay, nee Lechat, Bois Colombes; Maurice Deleville, Rosny sous Bois, both of France

[73] Assignee: Societe Anonyme dite: DELASCO, Paris, France

[21] Appl. No.: 753,488

[22] Filed: Dec. 22, 1976

[30] Foreign Application Priority Data

Dec. 23, 1975 France ..... 75 39567

[51] Int. Cl.[2] ..... F04B 43/08; F04B 43/12; F04B 45/06

[52] U.S. Cl. ..... 417/477; 138/118

[58] Field of Search ..... 417/477, 476, 475, 474; 251/6, 7; 138/118, 119, 177

[56] References Cited

U.S. PATENT DOCUMENTS

| | | | |
|---|---|---|---|
| 1,765,360 | 6/1930 | Baumann | 417/477 |
| 2,693,766 | 11/1954 | Setler | 417/477 |
| 2,917,002 | 12/1959 | Mascaro | 417/477 |

FOREIGN PATENT DOCUMENTS

| | | | |
|---|---|---|---|
| 1,191,815 | 10/1959 | France | 417/477 |
| 1,009,030 | 5/1957 | Germany | 417/476 |

*Primary Examiner*—Carlton R. Croyle
*Assistant Examiner*—Thomas I. Ross

[57] ABSTRACT

Deformable flexible tube constituting the body of a peristaltic pump having a stator and a rotor equipped with rollers progressively compressing the tube against the stator, said tube comprising two ribs extending along the length of the tube at points on the circumferential surface located on the same side of the line of contact of the inner walls when the tube is compressed, and symmetrical with respect to a plane perpendicular to this line of contact.

2 Claims, 4 Drawing Figures

DEFORMABLE FLEXIBLE TUBE CONSTITUTING THE BODY OF A PERISTALTIC PUMP

The present invention relates to a deformable flexible tube constituting the body of a peristaltic pump.

These pumps are known per se and generally comprise a flexible tube circularly curved along a stator and a mobile member constituted by a rotor equipped with rollers moving along the tube, compressing it so as to close its internal section, in order to form a zone of compression, downstream, and a zone of depression, upstream.

Reference will now be made to FIGS. 1 and 2 of the accompanying drawings. The wall of the tube will be presumed to be of uniform thickness A. To compress the tube, it is therefore sufficient that the roller be remote from the stator of the pump by a value 2A. In fact, as illustrated in FIG. 1, which shows a roller 1 remote from a stator 2 by a value equal to twice the thickness of a tube 3, it is observed that there are two spaces 4 having the drawback of constituting a communication between the zone of depression and the zone of compression of the pump. The pump can therefore not start correctly and lacks suction.

To remedy this drawback, it has been thought to crush the tube more strongly between the roller 1 and the stator 2. FIG. 2 shows that the distance B separating the roller 1 from the stator 2 is less than twice the thickness of the tube 3. In this arrangement, it is observed that the crushed material cannot spread correctly between the roller 1 and the stator 2 and that in zones 5 of the tube, there is an excess of matter which is taken along by the roller from the place where it contacts the tube to where it escapes. At this latter spot, the matter thus displaced returns by elasticity to its initial location and the resultant friction leads to a very rapid wear of the tube and consequently to its puncture.

It is an object of the present invention to remedy these drawbacks by proposing a tube which may be clamped, without being too strongly compressed, therefore avoiding the defect of the tube used according to FIG. 2, whilst not having zones of communication between high pressure and low pressure as referenced 4 in FIG. 1.

To this end, the invention relates to a deformable flexible tube constituting the body of a peristaltic pump, which comprises a stator and a rotor equipped with rollers which successively compress the tube against the stator. According to the invention, said tube comprises two outer ribs extending along the length of the tube at points on the circumferential surface located on the same side of the line of contact of the inner walls when the tube is compressed, and symmetrical with respect to a plane perpendicular to this line of contact.

It is advantageous to provide ribs whose length is at least equal to the circumferential distance separating two consecutive rollers.

The invention will be more readily understood on reading the following description with reference to the accompanying drawings, in which.

Figure 3:
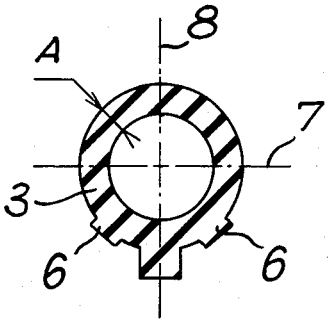
FIGS. 3 and 4 are views in section of a tube according to the invention, in the free state and clamped between a roller and the stator respectively.

Referring now to the drawings, FIG. 3 shows the tube 3 which has two outer ribs 6 disposed on the same side with respect to the contact line 7 of the inner walls of the tube, when said latter is compressed, and symmetrical with respect to a plane 8 perpendicular to this line 7.

Figure 1:
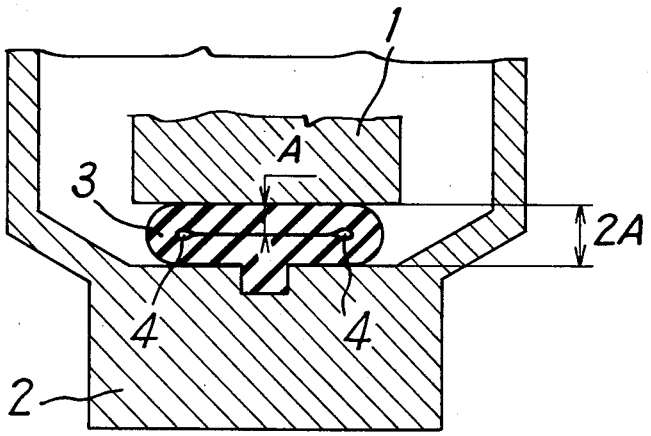
FIG. 1 PRIOR ART
FIGS. 1 and 2 are views in section of a known tube to which reference has been made hereinbefore.
Figure 2:
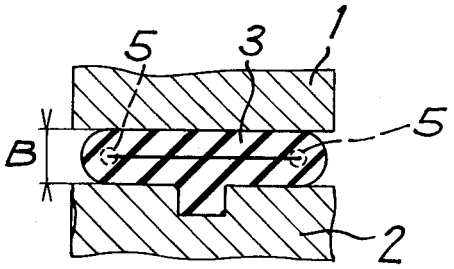
FIG. 2 PRIOR ART
Figure 4:
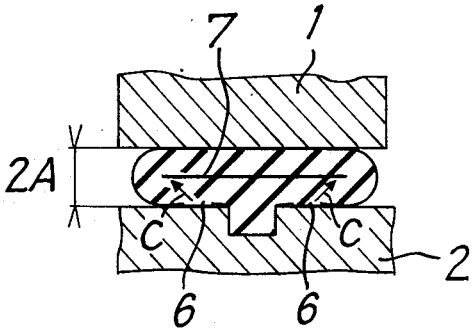

FIG. 4 shows the tube according to FIG. 3 compressed between the roller 1 and the stator 2 of a pump with flexible tube. The distance separating said roller from said stator is equal to twice the thickness A of the wall of the tube. Contrary to what occurs in FIG. 1, it will be noted that, at the ends of the line of contact 7 of the inner walls of the compressed tube, there are no free spaces 4. In fact, when the tube is crushed by the roller 1 against the stator 2, the two projecting parts 6 are compressed into the walls of the tube, this leading to a transfer of the matter from the outside of the tube to the inside, in the direction of arrows C, and to said spaces 4 being filled.

In this way, a complete closure is obtained between the high pressure stage and the low pressure stage of the pump without strongly compressing the tube nor risking the above-mentioned wear.

The invention finds interesting application in the field of the construction of pumps.

It is not limited to the description which has been made thereof but covers on the contrary all the variants thereto without departing from its scope. In particular, the said ribs 6 may either be on the side of the rib for centering the tube in the stator or on the opposite side.

What is claimed is:

1. Deformable flexible tube constituting the body of a peristaltic pump which comprises a stator and a rotor equipped with rollers, which progressively compresses the tube against the stator, said tube comprising two outer ribs extending along the length of the tube at points on the circumferential surface located on the same side of the line of contact of the inner walls when the tube is compressed, and symmetrical with respect to a plane perpendicular to said line of contact.

2. Tube as claimed in claim 1, wherein the length of said ribs is at least equal to the circumferential distance separating two consecutive rollers.

* * * * *